US005277330A

United States Patent [19]

Saussier

[11] Patent Number: 5,277,330

[45] Date of Patent: Jan. 11, 1994

[54] AUTOMATIC DISTRIBUTOR FOR PACKAGED ARTICLES

[75] Inventor: Jean-Louis Saussier, Lausanne, Switzerland

[73] Assignee: Planex S.A., Switzerland

[21] Appl. No.: 927,382

[22] PCT Filed: Feb. 10, 1992

[86] PCT No.: PCT/CH92/00025

§ 371 Date: Sep. 23, 1992

§ 102(e) Date: Sep. 23, 1992

[87] PCT Pub. No.: WO92/15076

PCT Pub. Date: Sep. 3, 1992

[30] Foreign Application Priority Data

Feb. 13, 1991 [FR] France ..... 91 01867

[51] Int. Cl.[5] ..... G07F 11/54

[52] U.S. Cl. ..... 221/5; 221/18; 221/115; 221/122; 221/133; 221/92

[58] Field of Search ..... 221/5, 17, 18, 113, 221/114, 115, 119, 120, 121, 122, 133, 155, 209, 86, 88, 92

[56] References Cited

U.S. PATENT DOCUMENTS

| | | | |
|---|---|---|---|
| 1,616,822 | 2/1927 | Petersen | 221/122 |
| 2,099,267 | 11/1937 | Hackett | 221/17 |
| 2,338,335 | 1/1944 | King | 221/122 X |
| 2,643,169 | 6/1953 | Wells et al. | 221/119 X |
| 2,696,324 | 12/1954 | Jones | 221/5 X |
| 2,738,102 | 3/1956 | Shepherd | 221/18 X |
| 2,849,068 | 8/1958 | Frank et al. | 221/18 X |
| 2,956,661 | 10/1960 | Radcliffe | 221/18 X |
| 3,351,232 | 11/1967 | Anderson | 221/113 |
| 4,069,943 | 1/1978 | Fawcett | 221/5 |

FOREIGN PATENT DOCUMENTS

| | | |
|---|---|---|
| 0038433 | 10/1981 | European Pat. Off. . |
| 0249367 | 12/1987 | European Pat. Off. . |
| 0339099 | 11/1989 | European Pat. Off. . |
| 1539507 | 9/1968 | France . |
| 2191767 | 12/1987 | United Kingdom . |
| WO9001755 | 2/1990 | World Int. Prop. O. . |

*Primary Examiner*—D. Glenn Dayoan
*Assistant Examiner*—Dean A. Reichard
*Attorney, Agent, or Firm*—Davis, Bujold & Streck

[57] ABSTRACT

The invention relates to a rotary magazine distributor apparatus (16) comprising a plurality of vertical channels (20) containing piles of respective different articles (6). The apparatus is arranged in order to dispense automatically articles selected by a buyer and which may have different prices. The rotary magazine (16) is provided with a powered driving system (24). A powered distribution mechanism (30) occupies a stationary location under the magazine and comprises an ejection finger (34) intended to push horizontally the lower article of the pile. A side casing (10) contains an electronic unit which controls all the distribution functions on the basis of information received from an electronic coiner, from a selection keyboard (15) and from stationary detectors (43) indicating the position of the magazine, the identity of the channels (20) and the presence of articles (6) in the channels.

10 Claims, 4 Drawing Sheets

AUTOMATIC DISTRIBUTOR FOR PACKAGED ARTICLES

FIELD OF THE INVENTION

The present invention concerns an automatic distributor for articles in generally parallelepiped packages, comprising:

a rotary magazine with a vertical axis, supported by a body, containing a plurality of generally vertical channels on its periphery, said channels designed to each hold a stack of articles and to in turn assume a dispensing position, means for gauging the magazine position, a distributing mechanism attached to the body designed to extract the lowest article from the stack in the channel which is in dispensing position and place that article near an opening for dispensing;

and control means comprising a motorized system for rotating the magazine, motorized control means for the distribution mechanism, a cash mechanism and a manual selector.

More particularly, the invention concerns a distribution apparatus for selling various items arranged in respective stacks.

BACKGROUND OF THE INVENTION

Publication No. WO 89/12873 describes a coin operated distribution device wherein the base of each channel of the magazine is formed by a vertically movable support usually in a raised position. Once the desired channel has been positioned for distribution by manually rotating the magazine, a coin is deposited in the apparatus to disengage the distribution device, which is activated manually so as to lower the support and eject the item on it. The mechanisms required for such a system of movable supports are relatively complicated, require considerable maintenance and are not readily adaptable to motorized control. Furthermore, the distributor is designed for items all selling at same price and cannot be easily adapted for items selling at different prices.

Publication No. FR-A-1-539 507A describes a device such as that described in the preamble, capable of automatically delivering an article which the customer has chosen by using a manual selector to indicate the corresponding channel. The distributed article is laterally ejected from the stack by a rotary lever traversing a slot in the base of each channel. The control system is electromechanical and, in order to gauge the position of the stacks, comprises a rotary finger connected to the magazine for successively activating electrical contacts distributed along the axis of rotation. One disadvantage to this system is that the distributor functions even if an empty channel has been selected. Furthermore, all the items must be the same price, since the cash mechanism functions independently of the selector. Finally, the electrical contact device is prone to frequent breakdowns.

SUMMARY OF THE INVENTION

The object of the present invention is to provide an automatic distributor designed to overcome the disadvantages described above, capable of selling different articles at different prices, with a simple structure and easily operated by the customer.

To achieve this, the invention concerns a distributor of the type described above, characterized in that the control means consists of an electronic control unit electrically connected to the selector, to the cash mechanism, the gauging means and to the motorized drive means in order to control said drive means, in that the gauging means comprises at least one channel detector connected to the electronic control unit indicating whether the channel contains at least one item, and in that said channel detector comprises movable sensors disposed at the base of each channel, respectively, and which can assume two different positions depending upon the presence or absence of articles in said channel; and at least one position detector installed in the unit, disposed to relay an electronic signal to the electronic control unit indicating the presence of one such sensor opposite it and the position of that sensor.

Thus, the electronic control unit can ensure that an article of the type selected is present in the channel or channels concerned, that the required amount of money has been deposited, and then that the magazine either is already in the correct position or has been positioned before it causes the magazine distributor to begin the function cycle.

In a particularly advantageous embodiment, each sensor has one shape-coded extremity to identify the channel corresponding to the sensor and the position detector comprises a group of optical detectors cooperating with said coded shape to transmit a digital code signal representing the identity of the channel corresponding to the sensor. Preferably, the distributor has an equal number of position detectors and sensors, with said detectors and sensors being distributed at equal angular intervals around the vertical axle and each sensor being opposite a position detector when any one of the channels is in dispensing position.

In an advantageous embodiment, each channel has a base supporting a stack of articles, said base being part of the rotary magazine, and a horizontal slot to allow passage of an ejection finger which is part of the distribution mechanism. The distribution mechanism may have a carrier holding the ejection finger, which carrier can be moved back and forth by turning a screw, said carrier being designed to tilt laterally around the screw according to the direction in which the screw is rotated, so that it is inclined at different angles when moving forward and when moving backward.

Preferably, the rotary magazine is attached to a central pivot in a lower portion of the unit and is completely surrounded by the elements of the unit, forming an at least partially transparent envelope. Between the ejection mechanism and the dispensing opening, the lower portion of the unit may have a chamber forming a deflector in the path of the ejected article.

The distributor may also be independently supplied with electricity by batteries housed in the unit.

Preferably, the cash mechanism, the manual selector and the electronic control means are located in a housing attached laterally to the body.

The advantages of the present invention will be more apparent from the following description of a preferred form of embodiment, presented by way of example, and from the attached drawings, in which:

DETAILED DESCRIPTION OF THE INVENTION

Figure 1:
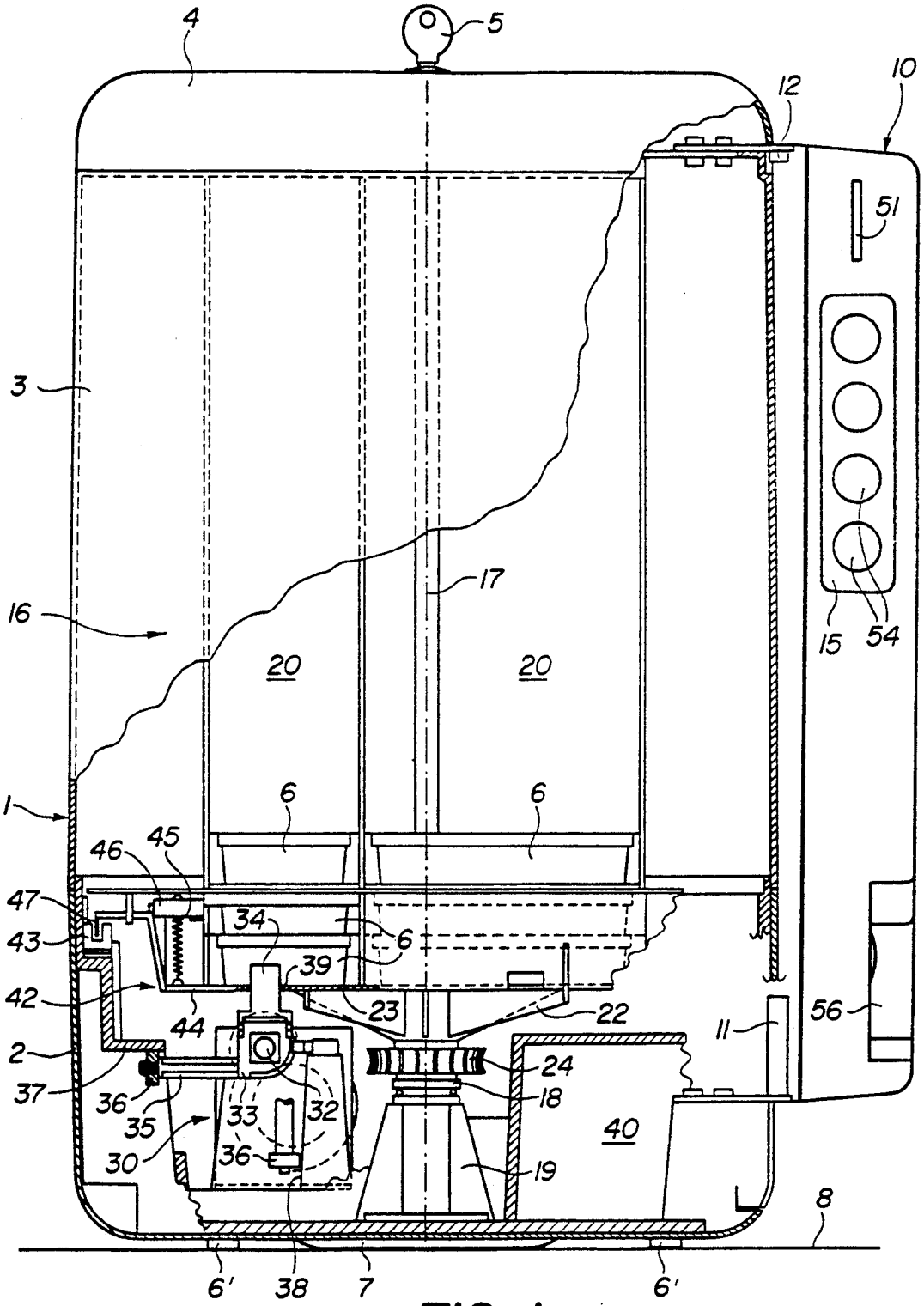
FIG. 1 is an elevation partially in cross-section of an automatic distributor according to the invention taken along line I—I of FIG. 3.

The distributor apparatus shown in the drawings comprises a body 1 consisting of an opaque lower portion 2, a transparent cylindrical intermediate portion 3 and a cover 4 which can be opened with a key 5 to load items to be dispensed into the apparatus. The lower body portion 2 has feet 6 and attachment means such as a central suction cup 7 for affixing it to a horizontal surface 8, for example in a vending area or bar. An attached housing 10 is laterally affixed to the body 1 with a pair of hinges 11 and 12 and a lock 13 activated by a key 14. Housing 10 essentially contains the distributor control means, in particular the four-button selection keyboard 15.

In the area of the transparent intermediate portion 3, body 1 contains a magazine 16 rotatable around a vertical axis 17 on a bearing 18 mounted on central base 19 connected to lower portion 2 of the body. Magazine 16 contains four vertical channels 20 of rectangular transverse section, each designed to hold a stack of articles 6 displayed for sale in the distributor. Articles 6 are preferably approximately parallelepiped in shape. However, it is necessary only for the upper and lower surfaces to allow them to slide against each another. In the present example, the four channels 20 are identical and have equally spaced angular separations, but this is not necessarily the case. Articles 6 may differ from one channel 20 to another. If their plane dimensions are different, even though the channels are identical, suitable complementary guides may be applied to the walls of channels 20. In the drawings, articles 6 are food products wrapped in tray-like packages that can be easily examined before purchase through the transparent wall of body portion 3. However, the same apparatus can dispense any type of article as long as it is suitably shaped and packaged.

Magazine 16 is preferably made of molded rigid synthetic material. In its lower portion, it comprises a central support 22 connected to the base 23 of each channel 20. This support is also connected to a toothed cogwheel 24 attacked by an endless screw 25 driven by an electric motor 26 for rotating magazine 16 and maintaining it in stopped position. In the present instance, the magazine has four stopped positions 90° apart, so that for each one, one channel 20 is in the so-called dispensing position opposite an exit chamber 27 traversed by each dispensed article 6 before reaching the dispensing opening 28 and being removed by the customer. Chamber 27 forms a deflector between the bottom of magazine 16 and opening 28 to prevent illicit access to the items in the magazine.

Figure 2:
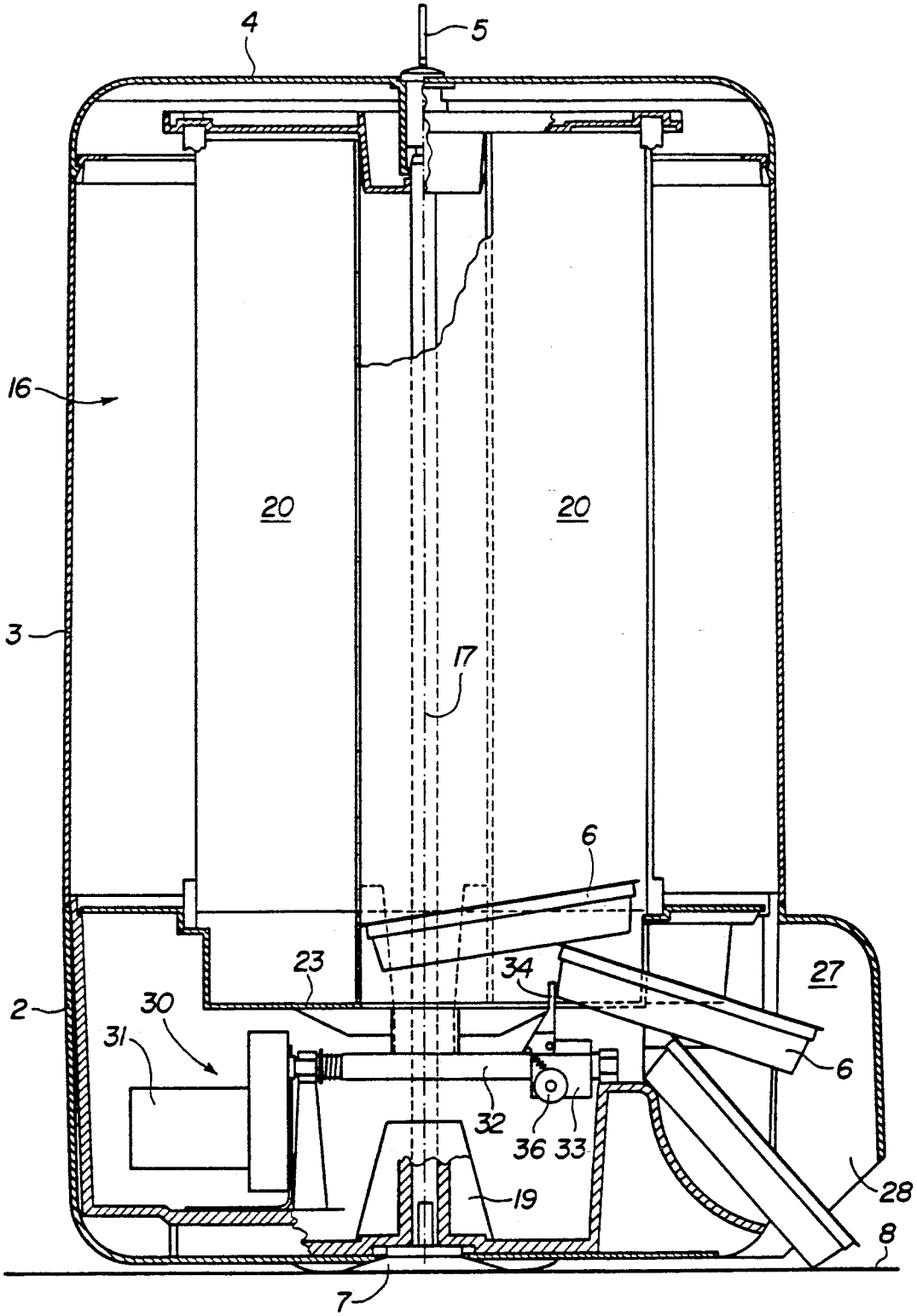
FIG. 2 is a vertical view, partially in cross-section, taken along line II—II of FIG. 3.

Beneath the dispensing position of channels 20, the lower portion 2 of the body contains a distribution mechanism 30 comprising an electric motor 31 which turns a horizontal screw 32 to linearly push carrier 33 holding a movable ejection finger 34. In addition, carrier 33 has a lateral arm 35 supporting a roller 36 designed to roll upon guide ramps 37 and 38. Finger 34 is designed to push article 6 resting on base 23 of channel 20 into chamber 27, as shown in FIG. 2, by passing through a longitudinal slot 39 in base 23 when screw 32 turns clockwise as in FIG. 1. The friction exerted by screw 32 tends to apply roller 36 against guide ramp 37. When screw 32 turns in the other direction, it tilts carrier 33 laterally so that finger 34 exits magazine 16 laterally while the carrier returns. Roller 36 is then guided by the other ramp 38.

In addition, lower portion 2 of the unit contains a compartment 40 designed to hold batteries 41 for independent electrical supply to the apparatus. Depending upon the situation, electricity can also be supplied by connecting it to a circuit.

Figure 3:
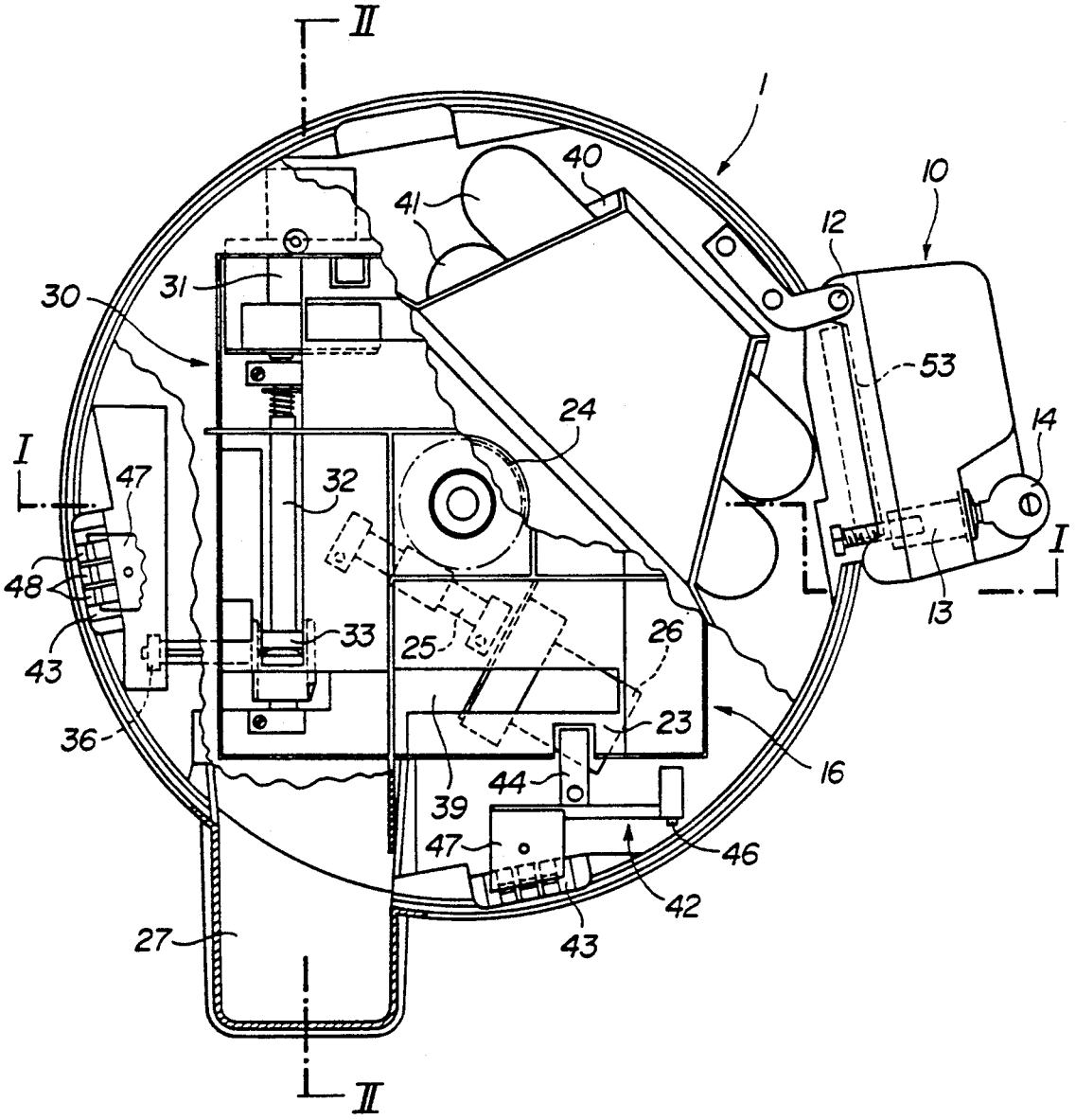
FIG. 3 is a horizontal cross-section of the distributor.

To indicate if one channel 20 is empty, each channel has tilting sensor 42 (FIG. 1) which, when the magazine is stopped, cooperates with any of the four stationary detectors 43 disposed at 90° angles along the unit. Sensor 42 comprises a plate 44 which tends to rise under the influence of spring 45 and contact article 6 resting on channel base 23 or descend if the channel is empty. In the latter case, sensor 42 tilts on its axis 46 and its extremity 47 is displaced into detector 43 when then emits the corresponding signal. Preferably, the extremity 47 of each sensor is shape-coded to identify the channel concerned. For example, as shown in FIG. 3, each detector 43 may consist of three optical detectors such as light barriers 48 or reflection sensors, while the extremities 47 of the different sensors have different shapes recognizable in relation to the barriers 48 which they break. These different shapes may consist of lips arranged differently on the four sensors and designed to obscure certain of the three light barriers to effect a three bit code. This code also detects the position of rotary magazine 16, since at least one of detectors 43 is equipped with light barriers for identifying a sensor 42 by its shape, even if the corresponding channel is not empty. Such a contactless device is advantageous because it is virtually trouble free.

Figure 4:
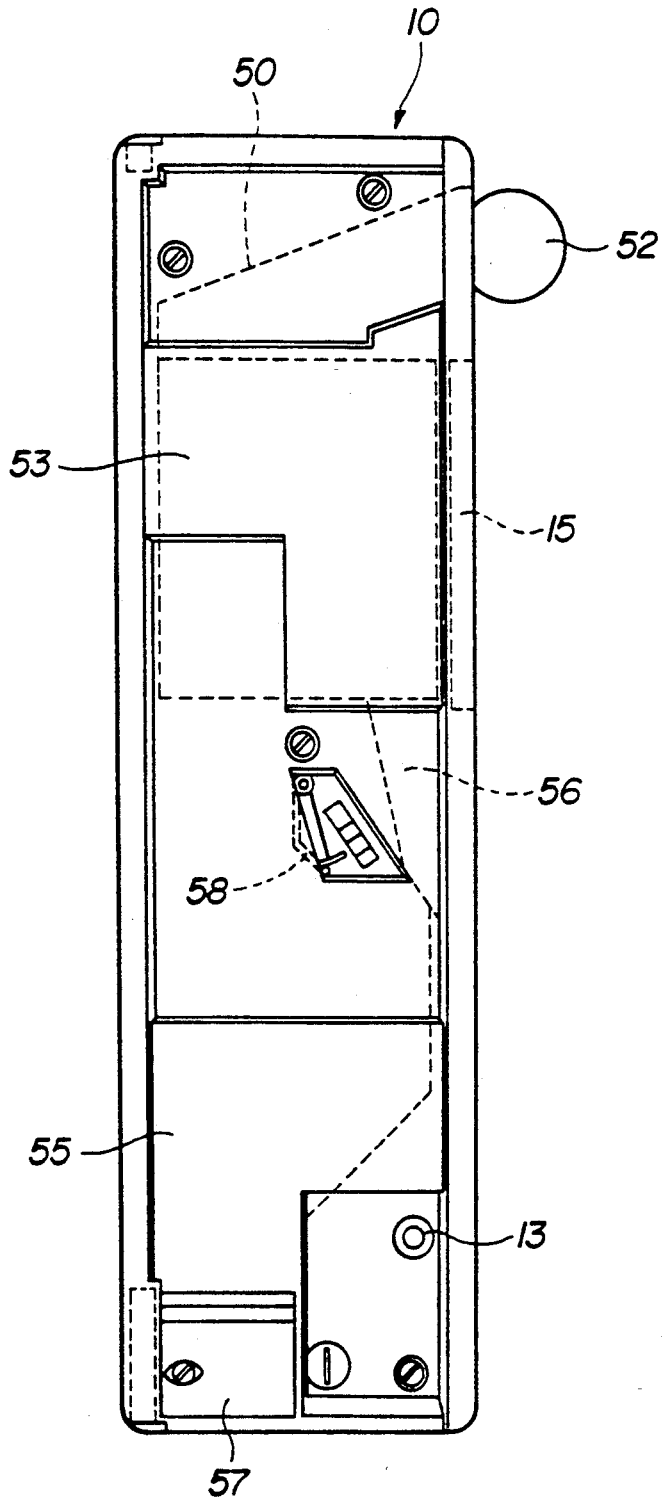
FIG. 4 is a vertical cross-section of the attached housing containing a coin device and an electronic control unit.

FIG. 4 shows schematically the principal elements in attached housing 10, seen from the axle side of the apparatus. The upper portion of housing 10 contains both an electronic coin device 50 with an inlet slot 51 (FIG. 1) for coins 52, and also an electronic control unit 53 to ensure automatic functioning of the apparatus according to the indications of coin device 50, selection keyboard 15 and detectors 43. Preferably, coin device 50 is designed to receive different coins in succession and total their respective values in unit 53. The latter may be programmed to compare the amount paid to the unit price of the item selected on keyboard 15. In this example, the keyboard has four buttons 54 corresponding to the four channels 20, but a simpler design is possible if the distributor is designed for only one type of item. Coin device 50 has a plugged coin reservoir with a movable base controlled by unit 53 which deposits coins either into a change compartment 55 if the article is to be dispensed, or into a return conduit 56 if the article selected is not available. At the base of coin compartment 55 there is a trap 57 for emptying it, accessible only when housing 10 is opened. Compartment 55 contains a gauge sensor 58 designed to notify unit 53 when the compartment is full.

One function cycle of the automatic distributor described above is as follows. The customer chooses the desired article 6 by pressing a button 54 on keyboard 15, then deposits coins into coin device 50 covering the price of the article selected. Electronic unit 53 then performs a series of tests which determine the remaining steps. If the coins deposited are not the type allowed, they are rejected. If electrical tension is insufficient, if channel 20 containing the desired article is empty, or if gauge 58 indicates that change compartment 55 is full, the coins are returned through conduit 56. Conversely, if the price of the item is covered, the coins remain in compartment 55. Unit 53 then tells rotation motor 26 to place the appropriate channel in the dispensing position, which is controlled by at least one of the detectors 43. It then engages a cycle of the distributor mechanism 30 to eject article 6, as shown in FIG. 2. The customer then receives the article at opening 28 and the apparatus is ready for another cycle.

The preceding description demonstrates that an automatic distributor according to the invention can be achieved using simple and reliable mechanical means completely controlled by a central electronic unit and backed up by an independent electrical supply.

The present invention is not limited to the exemplary embodiment described here, but extends to any modification or variation obvious to one skilled in the art. Applications for such a distributor include the sale of food or other products in packages which can slide along each other in at least one direction.

I claim:

1. Automatic distributor for articles wrapped in generally parallel piped packages, comprising:

a rotary magazine (16) with a vertical axle, supported by a body and comprising on its periphery a plurality of essentially vertical channels (20), said channels being designed to each hold a stack or articles (6) and to in turn assume a dispensing position, gauging means to detect magazine position, a distributing mechanism attached to the body and designed to extract the lowest article from the channel stack in dispensing position and place said article near a dispensing opening, and control means comprising a first electrically activated drive means (24–26) for rotating the magazine, a second electrically activated drive means (31–33) for the distributing mechanism (30), a cash mechanism (50) and a manual selector (15), characterized in that the control means consists of an electronic control unit (53) electrically connected to the selector, to the cash mechanism, to the gauging means and to the first and second drive means to control their functioning, in that the gauging means comprises at least one channel detector (42, 43) connected to the electronic control unit (53) and indicating whether or not a channel (20) contains at least one article, and in that said channel detector comprises movable sensors (42) respectively disposed at the bottom of each channel and assuming two different positions depending upon the presence or absence of an article in said channel, and at least one position detector (43) installed on the body and designed to deliver a signal to the electronic unit to indicate the presence of one of said sensors (42) opposite it and the position of such sensor, each sensor (42) has a shape-coded extremity (47) identifying the channel (20) corresponding to the sensor and in that the position detector (43) comprises a group of contactless detectors (48) cooperating with said coded shape to deliver a digital code signal representing the identity of the channel corresponding to the sensor.

2. Distributor according to claim 1, further comprising the same number of position detectors (43) and sensors (42), said detectors and said sensors being disposed at equal angular intervals around said vertical axle, with each sensor being opposite a position detector when any one of the channels (20) occupies the dispensing position.

3. Distributor according to claim 1, wherein each channel (20) comprises a base (23) supporting the stack of articles, said base forming part of the rotary magazine (16), and a horizontal slot (39) allowing passage of an ejection finger (34) which forms part of the distributing mechanism.

4. Distributor according to claim 3, wherein the distributing mechanism comprises a carrier (33) holding the ejection finger (34) and moved back and forth when a screw (32) is turned.

5. Distributor according to claim 4, wherein said carrier (33) is designed to tilt laterally around the screw depending upon the direction in which the screw is turned, so that it is inclined at different angles when moving forward and when moving backward.

6. Distributor according to claim 1, wherein the rotary magazine (16) is attached to a central pivot (18) in a lower portion (2) of the body and is completely surrounded by elements (2, 3, 4) of the body forming an at least partially transparent envelope.

7. Distributor according to claim 6, wherein the lower portion (2) of the body comprises, between the distributing mechanism and the dispensing opening (28), a chamber (27) forming a deflector in the path of an article ejected by the distributing mechanism.

8. Distributor according to claim 1, further comprising an independent electrical supply consisting of batteries (41) housed in the body (1).

9. Distributor according to claim 1, wherein the cash mechanism (50), the manual selector (15) and the electronic control unit (53) are located in an attached housing (10) laterally mounted to the body (1).

10. Distributor according to claim 1, wherein said contactless detectors are optical detectors.

* * * * *